US009670686B2

(12) United States Patent
Ruhmann et al.

(10) Patent No.: US 9,670,686 B2
(45) Date of Patent: Jun. 6, 2017

(54) GRANDSTAND

(71) Applicant: INTER+-POL Freie Forschungs- und Entwicklungsgesellschaft für unfassbare Formate, experimentelle Projekte, ungesehene Filme, dicke und dünne Bücher, grenzlose Räume, angewandte Streitkultur und Ideen aus ferner Zukunft mbH, Hamburg (DE)

(72) Inventors: Lars Ruhmann, Hamburg (DE); Timothy Pape, Berlin (DE); Mark Hofler, Berlin (DE); Tim Schierwater, Hamburg (DE); Harald Kloft, Frankfurt am Main (DE); Frank Bruckner, Muhltal (DE)

(73) Assignee: INTER+-POL Freie Forschungs- und Entwicklungsgesellschaft für unfassbare Formate experimentelle Projekte, ungesehene Filme, dicke und dünne Bücher, grenzlose Räume, angewandte Streitkultur und Ideen aus ferner Zukunft mbH, Hamburg (DE)

( * ) Notice: Subject to any disclaimer, the term of this patent is extended or adjusted under 35 U.S.C. 154(b) by 0 days.

(21) Appl. No.: 14/375,427

(22) PCT Filed: Sep. 29, 2012

(86) PCT No.: PCT/EP2012/069299

§ 371 (c)(1),
(2) Date: Dec. 11, 2014

(87) PCT Pub. No.: WO2013/113412

PCT Pub. Date: Aug. 8, 2013

(65) Prior Publication Data

US 2015/0275535 A1 Oct. 1, 2015

(30) Foreign Application Priority Data

Feb. 3, 2012 (EP) ..... 12153957

(51) Int. Cl.
*E04H 3/14* (2006.01)
*E04H 3/12* (2006.01)
(Continued)

(52) U.S. Cl.
CPC ..... *E04H 3/14* (2013.01); *E04H 3/12* (2013.01); *E04H 3/10* (2013.01); *E04H 3/123* (2013.01);
(Continued)

(58) Field of Classification Search
CPC ..... E04H 3/12; E04H 3/123; E04H 3/126; E04H 3/14; E04H 3/145; E04H 3/147; E04H 3/22; E04H 3/30; E04H 3/10
(Continued)

(56) References Cited

U.S. PATENT DOCUMENTS 663,950 A * 12/1900 Williams ..... E04H 3/12 52/8
2,052,217 A * 8/1936 De Sibour et al. ..... 52/8
(Continued)

FOREIGN PATENT DOCUMENTS

DE 2137589 A1 2/1973
DE 10301199 A1 * 7/2004 ..... E04B 7/102
(Continued)

*Primary Examiner* — Babajide Demuren
(74) *Attorney, Agent, or Firm* — Schwabe, Williamson & Wyatt, P.C.

(57) ABSTRACT

The invention relates to a grandstand having seat rows and/or standing space rows which rise in a stepped manner, wherein the grandstand has at least one first tier with at least one seat row and/or standing space row and at least one second tier with at least one seat row and/or standing space row, wherein the center of the second tier is arranged offset forward in the horizontal direction relative to the center of the first tier, wherein the gradient of at least one tier is greater than 45 degrees and/or the multiplicity of seats or
(Continued)

standing spaces permits lines of sight proceeding from the head of a visitor in the respective seat or standing space and ending on a line which runs along the longitudinal extent of the grandstand at a viewing distance (b) of approximately 0 to approximately 15 m and/or at least one tier with a multiplicity of seat rows and/or standing space rows is arranged such that the magnitude of the distance of the foremost space row from the playing field edge in the horizontal direction is smaller than the magnitude of the height of the foremost space row above the playing field. The invention also relates to a stadium having at least one such grandstand.

20 Claims, 8 Drawing Sheets

(51) Int. Cl.
*E04H 3/22* (2006.01)
*E04H 3/30* (2006.01)
*E04H 3/10* (2006.01)

(52) U.S. Cl.
CPC ..... *E04H 3/126* (2013.01); *E04H 3/22* (2013.01); *E04H 3/30* (2013.01)

(58) Field of Classification Search
USPC ..... 52/6, 8, 7, 73, 13, 79.2, 9, 10; 472/92, 472/94
See application file for complete search history.

(56) References Cited

U.S. PATENT DOCUMENTS

| | | | | | |
|---|---|---|---|---|---|
| 3,975,869 | A * | 8/1976 | Bouton | | 52/9 |
| 4,686,799 | A * | 8/1987 | Kwake | | 52/8 |
| 5,794,383 | A * | 8/1998 | Labinski | | 52/9 |
| 5,845,434 | A * | 12/1998 | Hayashi | E04H 14/00 | 472/59 |
| 5,850,712 | A * | 12/1998 | Errato | | 52/8 |
| 5,921,032 | A * | 7/1999 | Labinski | | 52/9 |
| 6,474,023 | B1 | 11/2002 | Takeuchi | | |
| 6,832,452 | B1 * | 12/2004 | Simens | | 52/6 |
| 8,474,191 | B2 * | 7/2013 | Magpuri | A63G 31/16 | 52/10 |
| 2006/0232582 | A1 | 10/2006 | Fannon | | |
| 2014/0283460 | A1 * | 9/2014 | Rossetti | E04H 3/12 | 52/8 |

FOREIGN PATENT DOCUMENTS

| | | | | | |
|---|---|---|---|---|---|
| DE | 10-2004045403 | B4 | | 4/2010 | |
| EP | 2626485 | A1 | | 8/2013 | |
| EP | 2812517 | A1 | | 12/2014 | |
| FR | 2703097 | A1 | | 9/1994 | |
| JP | 06200647 | A | * | 7/1994 | |
| JP | 06240895 | A | * | 8/1994 | E04H 3/12 |
| JP | 06313367 | A | * | 11/1994 | E04H 3/12 |
| WO | WO 2004029384 | A1 | * | 4/2004 | E04H 3/10 |

* cited by examiner

GRANDSTAND

CROSS REFERENCE TO RELATED APPLICATION

The present application is a 35 U.S.C. §371 national phase entry application of, and claims priority to, International Patent Application No. PCT/EP2012/069299, filed Sep. 29, 2012, which claims priority to German Patent Application No. DE 12123957.1, filed Feb. 3, 2012, the disclosures of which are hereby incorporated by reference in their entirety for all purposes.

BACKGROUND

The invention relates to a grandstand having seat rows and/or standing space rows which rise in a stepped manner, wherein the grandstand has at least one first tier with at least one seat row and/or standing space row and at least one second tier with at least one seat row and/or standing space row, wherein the centre of the second tier is arranged offset forward in the horizontal direction relative to the centre of the first tier.

Grandstands of the type mentioned in the introduction are normally used for enabling a multiplicity of users to observe a sporting fixture or cultural performance, wherein the stepped arrangement affords the spectators a better view of the events and/or allows a greater number of spectators to be accommodated in a restricted area.

DE 2137589 discloses a grandstand of the type mentioned in the introduction. Said grandstand however has the disadvantage that, on some upper tiers, the view is obstructed if the playing field or the stage extends near to the grandstand. If the playing field is a great distance away, such view obstructions are not encountered, but the events can then be followed only insufficiently owing to the distance.

DETAILED DESCRIPTION

Figure 1:
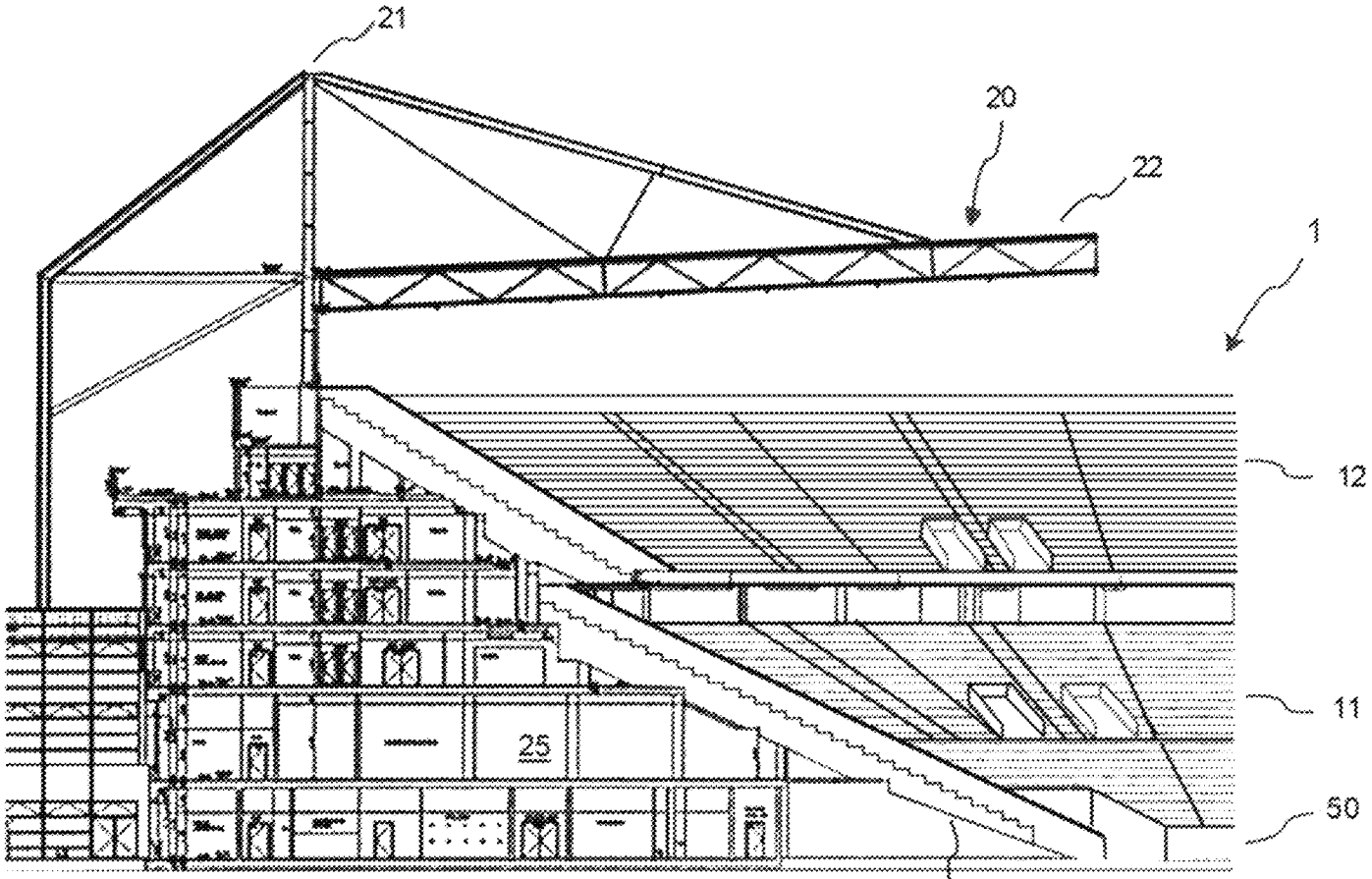
Fig. 1 (Prior Art)
FIG. 1 shows the cross section of a known grandstand.

The invention is thus based on the object of specifying a grandstand which offers improved viewing conditions and thus a more intense and/or immediate spectator experience of the respective event.

The object is achieved according to the invention by means of a grandstand according to Claim 1, a grandstand according to Claim 2, a grandstand according to Claim 4 and a stadium according to Claim 19.

The invention proposes a grandstand having seat rows and/or standing space rows which rise in a stepped manner. Here, exactly one row may be arranged on each step, such that each seat row or standing space row has a height difference with respect to the preceding seat row or standing space row. In other embodiments of the invention, more than one row may be arranged on one step, such that in each case groups of seat rows or standing space rows have a height difference with respect to one another. The height difference between two seat rows or standing space rows may in some embodiments of the invention be between approximately 10 cm and approximately 250 cm or between approximately 30 cm and approximately 200 cm or between approximately 45 cm and approximately 140 cm.

Where the following description refers to space rows, this is intended to mean both seat rows and also standing space rows if seats or standing spaces are not expressly referred to in the text. Seat rows differ from standing space rows in that the seat rows are provided with individual or interconnected, foldable or rigid seats. Between two adjacent seat rows or standing space rows there may be arranged an optional railing so as to impede the user of one such row from moving directly into the row below without using the access routes. In the case of large height differences between the individual space rows, such a railing may also be necessary for safety reasons. The space rows may also be equipped with novel seats or standing aids which are neither standing spaces nor seats in the conventional sense.

It is proposed according to the invention that the space rows be arranged, in a manner known per se, in at least one first tier and at least one second tier. Here, the first tier denotes a lower tier and the second tier denotes a higher tier arranged above the first tier in a vertical direction. In one embodiment of the invention, each tier may have at least one space row. In another embodiment of the invention, each tier may have a multiplicity of space rows. Two adjacent tiers may differ from one another by an increased spacing or height difference between two adjacent rows. Two adjacent tiers may be structurally clearly distinct. In some embodiments of the invention, two different tiers may be distinguished by different entrances. In this respect, a tier is a group of space rows which comprises at least one row.

It is preferable, but not imperative, for one tier to have additional passage areas, that is to say the visitors need not find their way to the lower space rows via the higher space rows but rather may for this purpose use dedicated passage areas or access areas or flights of steps.

In some embodiments of the invention, the tiers have more than 5, more than 6 or more than 7 space rows.

In the case of known grandstands, different tiers are normally staggered in a rearward direction, such that, with the height of the tier, both the height of the viewer above the playing field or the stage and also their horizontal distance therefrom increases. The line-of-sight length for a spectator is then defined as the hypotenuse of a right-angled triangle, the cathetuses of which are formed by the horizontal and the vertical distances. It is now proposed according to the invention that the centre of the second tier is arranged offset forward in the horizontal direction relative to the centre of the first tier. In this way, with the height of the tier, the vertical distance from the playing field or stage duly increases, but the horizontal distance decreases again. This can afford the spectator in the second, upper tier a better view of the events and/or better acoustics than in the case of known grandstands.

In some embodiments of the invention, the magnitude of the vertical distance of the spectator from the playing field edge may be greater than or equal to the magnitude of the horizontal distance of the spectator from the playing field edge. This has the effect that the events are seen in a viewing direction from above, similarly to the situation in a viewing tower. For the users of a stadium such as is known per se which has tiers staggered in a rearward direction, such a viewing direction is unfamiliar, which can afford a novel experience of the events on the playing field.

In some embodiments of the invention, the centre of a tier may be defined as the location at which the same number of rows is arranged above and below the centre. For example, the sixth row represents the centre of eleven rows. In the case of four rows, the centre would accordingly lie between the second and third rows. In other embodiments of the invention, the centre of a tier may also be defined in the manner of a centre of gravity, that is to say as the average, weighted with the total number of seats, of the position vectors of all of the seats of the tier.

In some embodiments of the invention, for at least one viewing distance, the average line-of-sight length for the second tier is less than or equal to the average line-of-sight length for the first tier. Since it is the case in known grandstands that, with height, the horizontal distance of the tier also increases, the line-of-sight length for the spectators on the upper tiers becomes greater than the line-of-sight length for the spectators on the lower tiers. Above a certain size of grandstand, the line-of-sight length becomes so great that the spectator can no longer identify details, or it becomes necessary to use binoculars or similar optical instruments. As a result of the staggering of the tiers in the forward direction, that is to say in the direction of the playing field or the stage, as proposed according to the invention, the average line-of-sight length is, for at least one viewing distance, reduced. In this way, the visitors at the event are afforded a better view of the events. In particular, the view of the most obscured and furthest remote regions of the events is improved.

In some embodiments of the invention, the definitive viewing distance for which the average line-of-sight length is reduced may be the most remote possible viewing distance. For example, this may be the rear edge of a stage, the playing field boundary situated opposite the grandstand, or the furthest remote visible point of a racetrack. In this case, the average line-of-sight length for all of the spectators in one tier is duly not shortened for all viewing distances, but it has nevertheless surprisingly been found that the view is more balanced or improved overall.

In other embodiments of the invention, the viewing distance for which the average line-of-sight length is reduced may be selected so as to be the shortest possible viewing distance, for example the adjacent sideline of a playing field, the front edge of a stage, or that track section of a racetrack which is directly adjacent to the grandstand. In this case, for all viewing distances, the average line-of-sight length for the second tier is shorter than the average line-of-sight length for the first tier situated therebelow.

In other embodiments of the invention, the viewing distance for which the average line-of-sight length is reduced may be approximately 180 m to approximately 5 m. In other embodiments of the invention, the viewing distance for which the average line-of-sight length is reduced may be approximately 120 m to approximately 50 m. In yet another embodiment of the invention, the viewing distance for which the average line-of-sight length is reduced may be approximately 90 m to approximately 60 m. In yet another embodiment of the invention, the viewing distance for which the average line-of-sight length is reduced may be approximately 0 m to approximately 15 m. In yet another embodiment of the invention, the viewing distance for which the average line-of-sight length is reduced may be approximately 7 m to approximately 10 m. In yet another embodiment of the invention, the viewing distance for which the average line-of-sight length is reduced may be approximately 7 m to approximately 8 m. The respectively selected viewing distance may be dependent on the nature of the events to be observed from the grandstand. For example, the width of a football field is often approximately 70 m, such that a viewing distance to the opposite boundary line of the playing field is of the stated scale. In some embodiments of the invention, a football field may adjoin the grandstand without a running track being arranged between the grandstand and the playing field. In this case, the adjoining boundary line of the playing field may be at a distance of between 0 and 15 m or between 7 and 8 m from the front edge of the grandstand.

In some embodiments of the invention, the multiplicity of seats or standing spaces of the grandstand may permit lines of sight proceeding from the head of a visitor in the respective seat or standing space and ending on a line which runs along the longitudinal extent of the grandstand at a viewing distance of approximately 0 m to approximately 15 m. In some embodiments of the invention, this may be the case for more than 90% of the spaces, more than 95% or more than 99% of the spaces. In this case, all of the visitors can see the adjacent boundary line of the playing field, such that there is no view obstruction. The grandstand may then have the cross-sectional shape of a convergent lens or of a focussing mirror, wherein all of the lines of sight are oriented towards a line which runs parallel to and in front of the grandstand. The orientation of the tiers of the grandstand towards one point provides a dramatic wave-like appearance.

Over the grandstand there may be arranged an optional roof which protrudes over at least a part of the tiers and protects the visitors against weather conditions. The roof may cover all of the seats or some of the seats.

In some embodiments of the invention, the supporting structure which bears at least one tier and an optional protruding roof may be formed as a plane load-bearing structure.

In some embodiments of the invention, the supporting structure which bears at least one tier and an optional protruding roof may comprise at least one disc-shaped element. The disc-shaped element of the supporting structure may, in some embodiments of the invention, be arranged substantially vertically. In some embodiments of the invention, this is meant if the deviation with respect to the vertical is less than 20°, less than 10° or less than 5°. The disc-shaped element may be of planar form or may have different component surfaces which have different inclinations. Such a disc-shaped element can dissipate acting forces, for example imposed loads on a tier or wind or snow loads acting on the roof, directly into the foundations. By contrast to horizontal elements which distribute introduced forces only horizontally and transmit said forces to substantially vertically running core structures, the structure according to the invention ensures that less deformation occurs. In this way, the oscillation behaviour of the grandstand can be improved.

The disc-shaped element may have at least one portion or at least one component surface which protrudes beyond the base point on the foundation. In this way, the staggering of the tiers in the direction of the playing field, according to the invention, can be realized in a simple manner.

In some embodiments of the invention, the disc-shaped element may comprise or be composed of reinforced concrete. The disc-shaped element may be formed from cast-in-place concrete or as a precast concrete part or as a semifinished part. Such an element may exhibit increased damping and/or reduced deformation, yielding improved oscillation behaviour in relation to a steel structure.

In some embodiments of the invention, it is possible for the supporting structure and the roof to have an outer side with at least one convex longitudinal portion and/or an inner side with at least one concave longitudinal portion, and for the second tier to be arranged on the inner side. This firstly yields an organic form which exhibits low load peaks in the load-bearing components. As a result of reflections running across the curved roof, sound is transmitted well from tier to tier such that good acoustic coupling of the tiers to one another and to the playing field is attained. The construction of the grandstand can be simplified in this way. Furthermore, the stated form ensures that the second tier, which is arranged above the first tier, is horizontally at a smaller distance from the playing field or the location of the events, and both tiers are protected against weather conditions by the roof. An inner side having at least one concave longitudinal portion may also, in some embodiments, be realized by means of a concave arc which is straightened in portions.

In some embodiments of the invention, at least one further tier may be provided which is arranged at least partially above the second tier and fastened to the supporting structure. In this way, it is possible to create grandstands having three, four, five, six, seven or more tiers, wherein at least two tiers are arranged such that the lower tier is at a greater horizontal distance from the location of the events than the tier situated thereabove.

In some embodiments of the invention, all of the tiers may be arranged so as to be staggered in the forward direction, such that the upper tier in each case is a smaller horizontal distance away than the tier situated therebelow. In this way, the audience capacity can be further increased without the viewing conditions on the upper tiers being restricted.

In some embodiments of the invention, a grandstand of said type may accommodate more than 2000 visitors, more than 3000 visitors or more than 5000 visitors. In some embodiments of the invention, multiple grandstands may be combined to form a stadium, which can accordingly accommodate more than 3000, more than 10 000 or more than 30 000 or more than 40 000 visitors. A multiplicity of grandstands may be statically independent of one another, for example on opposite sides of a playing field. In other embodiments of the invention, a multiplicity of grandstands may form a common static system.

In some embodiments of the invention, the second tier and/or a further tier can generate at least a tensile force in the supporting structure. By contrast to known grandstands, in which the supporting structure of the tier usually also bears a roof, it is proposed according to the invention that the structure of the roof also bears at least one tier. This means that at least the weight formed of the own weight and the imposed loads is dissipated via the supporting structure of the roof.

In some embodiments of the invention, an opening may be formed between the second tier and/or the further tier and the roof. The opening may, in some embodiments of the invention, have a width of 30 cm to 5 m. The opening may be formed continuously along the longitudinal extent or may have discontinuities. In the opening there may be arranged a catching net, a wire mesh or a rope mesh for preventing objects or persons from falling through the opening. The opening may serve to permit the propagation of sound from the location of the events along the roof and thus behind the tier. This can afford the user of the tier an improved acoustic experience and good acoustic communication between the tiers and/or between a tier and the playing field.

In some embodiments of the invention, the gradient of the space rows, which rise in a stepped manner, of a selected tier may be smaller than the gradient of the space rows, which rise in a stepped manner, of the tier situated thereabove. Such an embodiment affords in particular the users of an upper tier, who are on average at a smaller horizontal distance from the location of the events, an improved view of the near region.

In some embodiments of the invention, the gradient of the space rows which rise in a stepped manner may be approximately 37° to approximately 80°. In some embodiments of the invention, the gradient of the space rows which rise in a stepped manner may be approximately 40° to approximately 75°. In some embodiments of the invention, the gradient of the space rows which rise in a stepped manner may be approximately 45° to approximately 65°. The gradient of at least one tier may be greater than 49 degrees or greater than 55 degrees or greater than 65 degrees. In some embodiments of the invention, the grandstand may have two or more tiers which each have a gradient of greater than 45°. Tiers with the stated gradient are the most successful in resolving the compromise between view obstruction by the row in front and usability or accessibility for users. In particular, in the case of the stated gradient, the users even of an upper tier can still comfortably follow the events at a point in the near region in front of the grandstand or the events directly in front of the grandstand with little or no view obstructions.

In some embodiments of the invention, the number of space rows in a tier may decrease with the height of the tier. It would thus be the case that the lowermost tier has the most space rows and the uppermost tier has the fewest. This firstly facilitates evacuation in an emergency, because fewer persons must be evacuated from the upper tiers. Furthermore, such an embodiment has the advantage that the structural height of the grandstand and thus both the wind loads and also the average line-of-sight lengths can be reduced.

In some embodiments, the number of space rows in a tier may decrease with the height of the tier, wherein the uppermost tier may be elongated rearwards. This is possible in the proposed geometry of the grandstand because, in the uppermost tier in each case, the view is not limited by a tier situated therebelow.

In some embodiments of the invention, at least one side of the grandstand may be at least partially closed off by a weather and/or sound protection screen, such that the users of the grandstand are less exposed to wind and precipitation.

In some embodiments of the invention, the weather and/or sound protection screen may comprise a membrane or glass. The membrane or the glass may be of transparent or translucent form. In some embodiments of the invention, the membrane may comprise or be composed of poly(ethylene-co-tetrafluoroethylene). A membrane formed in this way does not influence the feeling of space in the grandstand, that is to say the users do not feel cramped in a closed space, but rather enjoy a clear view in all directions. Likewise, such a membrane is adequately weather-resistant, such that the visual impression is not impaired even after many years of use.

In some embodiments of the invention, on the front edge of at least one tier, on at least one longitudinal portion, there may be arranged a catching chamber which is delimited by at least one base panel and a distal delimiting element. Here, the front edge of the tier refers to the side facing towards the location of the events. The distal delimiting element is that element which defines the front edge of the respective tier and which is thus furthest remote from the tier. The catching chamber may thus be formed such that objects which are accidentally dropped or objects which are wantonly thrown are collected in the catching chamber such that they cannot reach tiers situated therebelow or the playing field. The safety of the users of the grandstand and of the players at the location of the events is increased in this way.

In some embodiments, for a further increase in safety, catching nets may also be stretched in front of and/or behind the tiers, over the entire length or in sections.

The invention shall be explained in more detail below on the basis of figures, without restriction of the general concept of the invention. In the figures:

FIG. 1 shows the cross section of a grandstand 1 known per se. The grandstand has a lower tier 11 and an upper tier 12 situated thereabove. Each tier is provided with a multiplicity of seat rows and/or standing space rows which rise in a stepped manner. The tiers 11 and 12 are borne by a supporting structure 112. The front edge of the tier 11 is adjoined by a playing field 50 on which an event of interest to the spectators can take place, for example a sporting fixture or a cultural performance.

In the space below the grandstand 1 there may be arranged function rooms 25, for example catering outlets, lavatory facilities, cloakroom facilities or passages through which visitors can access the tiers 11 and 12 and thus the seats or standing spaces.

It is clear from FIG. 1 that the lower tier 11 is arranged closer to the playing field 50 than the upper tier 12. That is to say the front edge of the tier 11 adjoins the playing field 50 and the front edge of the tier 12 is situated approximately the same horizontal distance away as the rear edge of the tier 11. The visitors in the upper tier 12 are thus on average both at a greater horizontal distance from the playing field 50 and also at a greater vertical distance therefrom, or at a greater height.

Furthermore, the known grandstand 1 has a roof 20 which is provided with a roof skin 22 which is fastened to a load-bearing structure 21. The load-bearing structure 21 dissipates forces acting on the roof 20, in particular its own weight, wind loads and snow loads, into the supporting structure 112 of the grandstand. The forces acting on the roof 20 are then dissipated via the supporting structure 112 into the foundations. In this respect, the structure of the grandstand 1 and the structure 112 of the tiers 11 and 12 also bear the roof 20.

Figure 2:
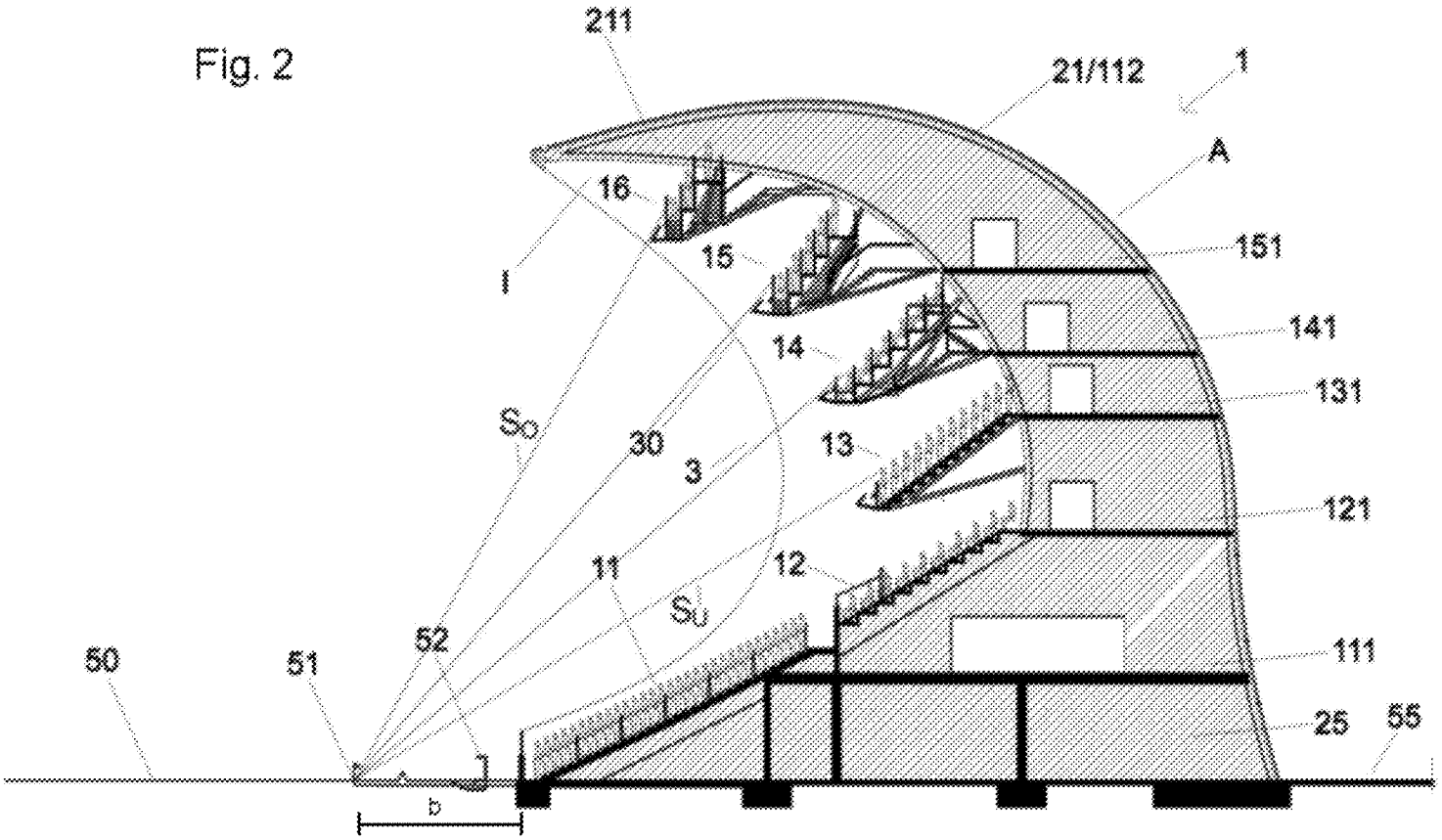
FIG. 2 shows the cross section of a grandstand as per an embodiment of the invention.

FIG. 2 shows a cross section through a grandstand according to the present invention. The grandstand 1 according to the invention is also arranged at the edge of a playing field 50 or of some other location which draws the interest of a multiplicity of spectators. In this respect, the playing field 50 may also be replaced by a stage, a racetrack or the like.

The playing field 50 is, in the exemplary embodiment illustrated, delimited by a corner flag 51. In the sectional illustration, the location of the corner flag 51 also indicates the course of a sideline, which runs perpendicular to the drawing plane, of the playing field 50. In the region between the corner flag 51 and the start of the grandstand 1 there may be arranged an optional trainers' bench 52. The corner flag or the sideline which delimits the playing field may run at a distance b in front of the grandstand, wherein b may be approximately 0 m to approximately 15 m or approximately 7 m to approximately 10 m or approximately 7 m to approximately 8 m.

The grandstand 1 likewise has a load-bearing structure 112. At least one tier is fastened to said load-bearing structure. In the exemplary embodiment illustrated, the grandstand 1 has six tiers 11, 12, 13, 14, 15 and 16. In other embodiments of the invention, the number of tiers may be greater or even smaller. In particular, in some embodiments of the invention, the tier 11 may be omitted. This affords the spectators a more immediate experience of the events.

In the case of the grandstand 1 according to the invention, too, function rooms 25 may be arranged below the tiers. In some embodiments of the invention, a multiplicity of tiers or each tier is assigned one access level 111, 121, 131, 141 and 151 such that the visitor flows can be channeled separately. The accommodation of the spectators and/or the evacuation of the grandstand 1 can be improved in this way.

Figure 3:
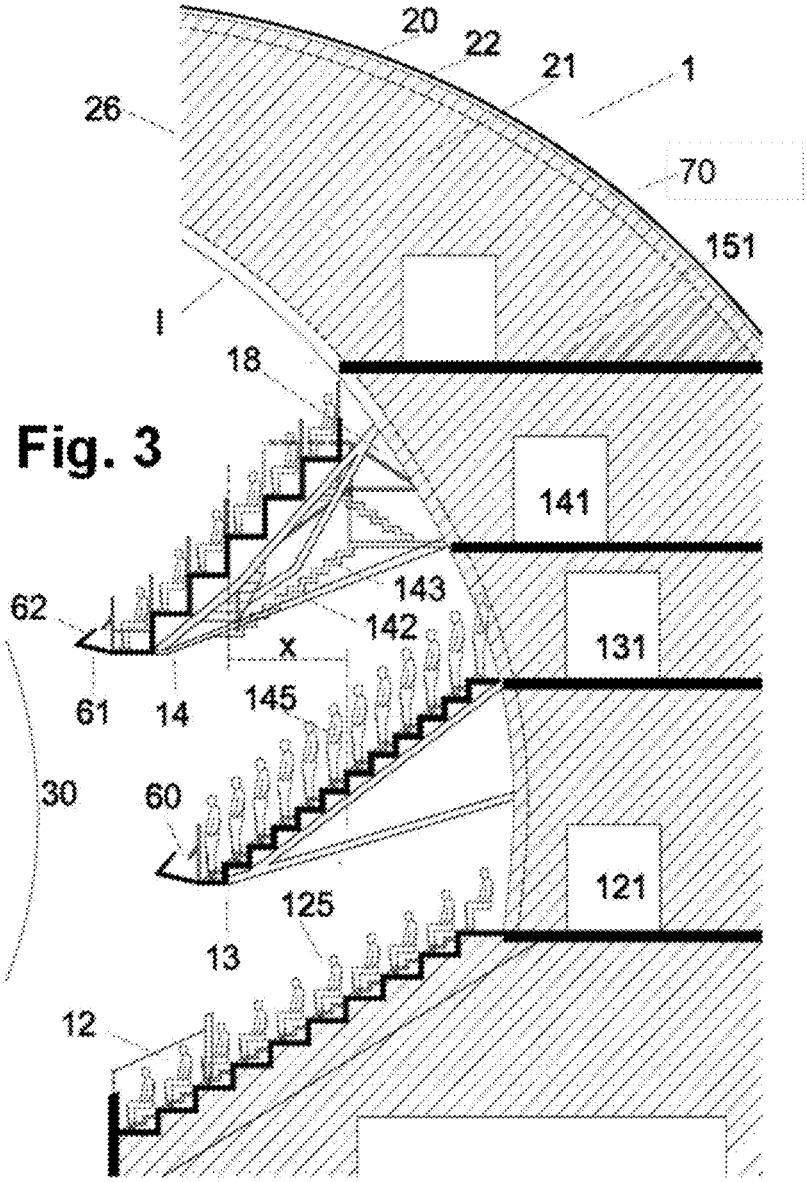
FIG. 3 shows a detail from FIG. 2.

As is clear from FIG. 2 and from the detail as per FIG. 3, the tier 14 is arranged above tier 13. Furthermore, the centre of the tier 14 is positioned in front of the centre of the tier 13, that is to say the average horizontal distance of the visitors in tier 14 from the playing field 50 is smaller by the magnitude X than the average horizontal distance of the visitors in tier 13 therefrom. The same also applies for the relationship between tier 14 and tier 15 and to the relationship between tier 15 and tier 16. In this way, the average horizontal distance decreases with increasing vertical distance from the playing field 50. In this way, the visitors can on average be afforded a better view of the events.

It can furthermore be seen from FIG. 3 that the tiers 12 and 13 have a multiplicity of seat rows 125 and that tier 14 has a multiplicity of standing space rows 145. Here, the principle of the invention can be applied universally to seat rows and/or standing space rows. The type of space rows provided on the tiers may be selected in dependence on the respective application, that is to say in dependence on the comfort expectations of the visitors and the number of visitors to be accommodated.

It can furthermore be seen from FIGS. 2 and 3 that the gradient of the tiers, defined as the ratio between the horizontal and vertical distances of two adjacent space rows, increases with increasing height of the tier. In this way, view obstructions in the upper rows of each tier can be avoided. It is thus possible for all visitors in a tier to be afforded an unobstructed view both of a remote point of the playing field 50 and also of a point adjacent to the grandstand 1, or the adjacent sideline 51 of the playing field.

In the exemplary embodiment illustrated, the forward staggering according to the invention of two adjacent tiers by the magnitude X is attained by virtue of the grandstand 1 having a convex outer side 70 and a concave inner side I. In other embodiments of the invention, it is self-evidently also possible for other structural embodiments to be selected, for example by means of a straightening of the inner side I with simultaneous elongation of the load-bearing structure 142 of the tier 14.

The curvature of the concave inner side and the gradient of the tiers may be selected such that the lines of sight So and Su of all of the visitors end, in the case of a straight viewing direction, at the near sideline 51. This yields a structure in the manner of a convergent lens.

Figure 5:
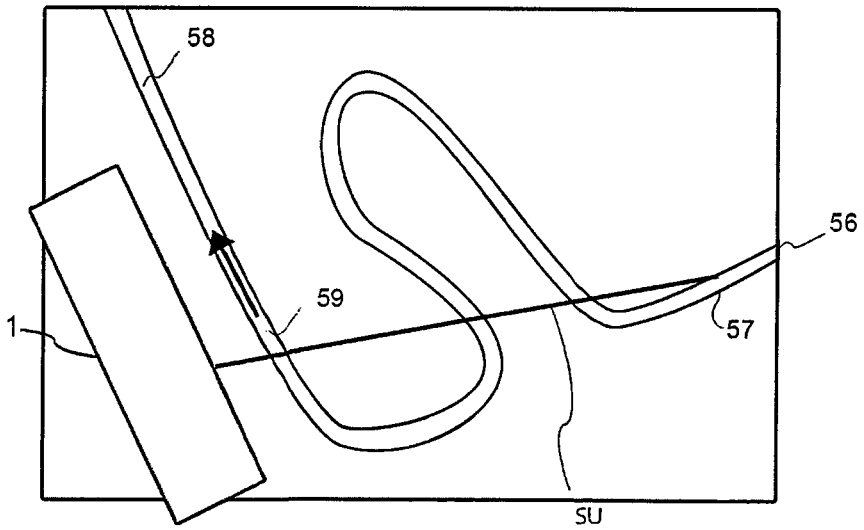
FIG. 5 explains the selection of the viewing distance for a particular application.

The specific geometry results in a further phenomenon with regard to view quality: with increasing height, the difference between the furthest remote point and the nearest point of the playing field becomes progressively smaller. If the horizontal distance to the closest point of the events is smaller than the height of the viewpoint, the corresponding line of sight has a gradient of greater than 100% and thus provides predominantly a plan view or a view from above of the events. By contrast to conventional stadia, in which the game is observed predominantly from the side, the positioning of the steep tiers at great height and simultaneously close to the playing field affords a view which evolves towards a balanced "overview from obliquely above" (FIG. 5). This is a pleasant and spectacular perspective hitherto known to spectators only from television broadcasts.

In the exemplary embodiment illustrated, the load-bearing structure 112 of the grandstand is designed such that it simultaneously bears the roof skin 22 on the convex outer side 70. In some embodiments, the convex outer side of the structure and consequently of the roof may also, in sections, be straightened or form a right angle with a virtually horizontal roof surface. A separate load-bearing structure 21 for the roof 20 is therefore no longer required, or the load-bearing structure 21 of the roof simultaneously bears the tiers 13, 14, 15 and 16. As a roof for the uppermost tier 16 only, a further roof supporting structure 211 may be used which is not loaded by the load of the tiers.

To reduce the nuisance caused to the visitors on the tiers 11, 12, 13, 14, 15 and 16 by weather conditions, an optional weather and/or sound protection screen 30 may be arranged on the sides of the grandstand 1. In some embodiments of the invention, said weather and/or sound protection screen may comprise or be composed of a membrane 30 which is translucent or transparent, so as to thereby not hinder the impression of space for the visitors on the tiers.

FIG. 3 also shows how an optional catching chamber 60 may be arranged in front of the tiers. The catching chamber 60 may be formed over the entire longitudinal extent running perpendicular to the drawing plane, or may be formed only in a partial section. The catching chamber 60 is delimited by at least one base panel 61 and at least one distal delimiting element 62. In this way, objects which are dropped or thrown by the visitors on the upper tiers can be collected in the catching chamber 60, without said objects posing a hazard to visitors on the lower tiers or to the players on the playing field 50.

Finally, FIG. 3 shows that at least one opening 18 is formed between the tier 14 and the inner side I of the grandstand 1. The opening of the tiers to the rear and the concave roof shape serves to ensure optimum communication and a more intense atmosphere on the grandstand. To prevent objects from falling through the opening 18 onto tiers situated below, the opening 18 may be at least partially closed off by a catching net, a membrane or a grating.

FIG. 4 shows once again the design principle on which the invention is based. The illustration shows a cross section through a schematic playing field 50 with a remote corner flag or sideline 51*a* and a near corner flag or sideline 51*b*. The lower tier 13 is arranged at a height Y above the playing field 50 and at a horizontal distance X from the sideline 51. This yields a first line-of-sight length SU for the respective visitor.

The tier 14 arranged thereabove is at a smaller distance X and a greater height Y. This yields a second line-of-sight length SO for the visitors in tier 14 to the sideline 51*a*. Averaging all of the line-of-sight lengths for all of the visitors in a tier yields an average line-of-sight length. As is readily apparent from FIG. 4, the second average line-of-sight length SO is smaller than the first average line-of-sight length SU if the centre of the tier 14 is arranged in front of the pitch circle T which describes a line of equal line-of-sight lengths.

By contrast to known grandstands as illustrated in FIG. 1, the average line-of-sight length to a remote point of the events is thus smaller for the upper tier 14 than for the lower tier 13. In this way, the visitors in the upper tiers are afforded an improved experience of the event.

Figure 4:
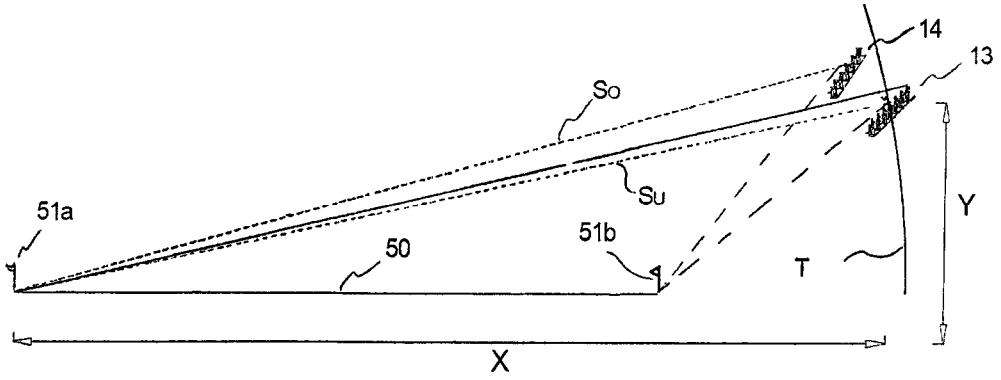
FIG. 4 explains the shortening of the line-of-sight length in dependence on the height of the tier.

If the tiers 13 and 14 are arranged such that, for the smallest possible viewing distance x, the second average line-of-sight length SO is smaller than the first average line-of-sight length SU, this relationship applies for all possible average line-of-sight lengths. In the example of FIG. 4, this would relate to the distance to the near sideline 51*b*.

If the tiers are arranged such that the second line-of-sight length SO is smaller than the first line-of-sight length SU only for the furthest remote regions of the events of the game, the second average line-of-sight length SO becomes longer than the first average line-of-sight length SU again for shorter viewing distances. It is thus made possible for the spectators to see the events on the playing field 50 from a completely new viewing angle, because in this way, the overall view of the events is made more balanced and clearer. In this respect, it may suffice for the determination of the arrangement of the tiers 13, 14 to be based on the greatest possible horizontal viewing distance x. In the illustrated exemplary embodiment of a playing field 50, said greatest possible viewing distance is defined by the sideline 51*a* situated opposite the grandstand 1.

As can also be seen from FIG. 4, the illustrated grandstand construction with increasing gradient of the upper tiers affords an unobstructed view of the near sideline 51*b*, without the visitors in the upper tier 14 having their view obstructed by the lower tier 13.

It should be noted that the inclination of the lines of sight may differ from the inclination of the tiers, because the visitors in the rear rows of each tier must look over the visitors in the front rows. The inclination of the lines of sight may thus differ from the inclination of the tier by approximately 2° to approximately 10° or by approximately 3° to approximately 5°.

FIG. 5 shows another exemplary embodiment of the invention. In FIG. 5, the grandstand 1 is arranged at a racetrack 56. In this case, the vehicles on the racetrack 56 become visible to the visitors in the grandstand 1 for the first time at a remote point 57. The point 57 may be defined either by the greatest possible range of sight, by a preceding corner or by an obscured track profile. The vehicles are then continuously in the field of view until they become obscured at the point 58. The point 58 may also be defined either by the greatest possible range of sight or by an obscured track profile. The greatest possible viewing distance X would then be defined by the distance from the point 57 to the grandstand 1, and the smallest possible viewing distance would be defined by the distance from the point 59 to the grandstand 1 or to the respective visitor. It is thus possible for the arrangement of the tiers 13 and 14 to be easily optimized for a predefinable viewing distance X, either for the greatest possible distance or for the smallest possible distance or for an intermediate value.

Figure 6:
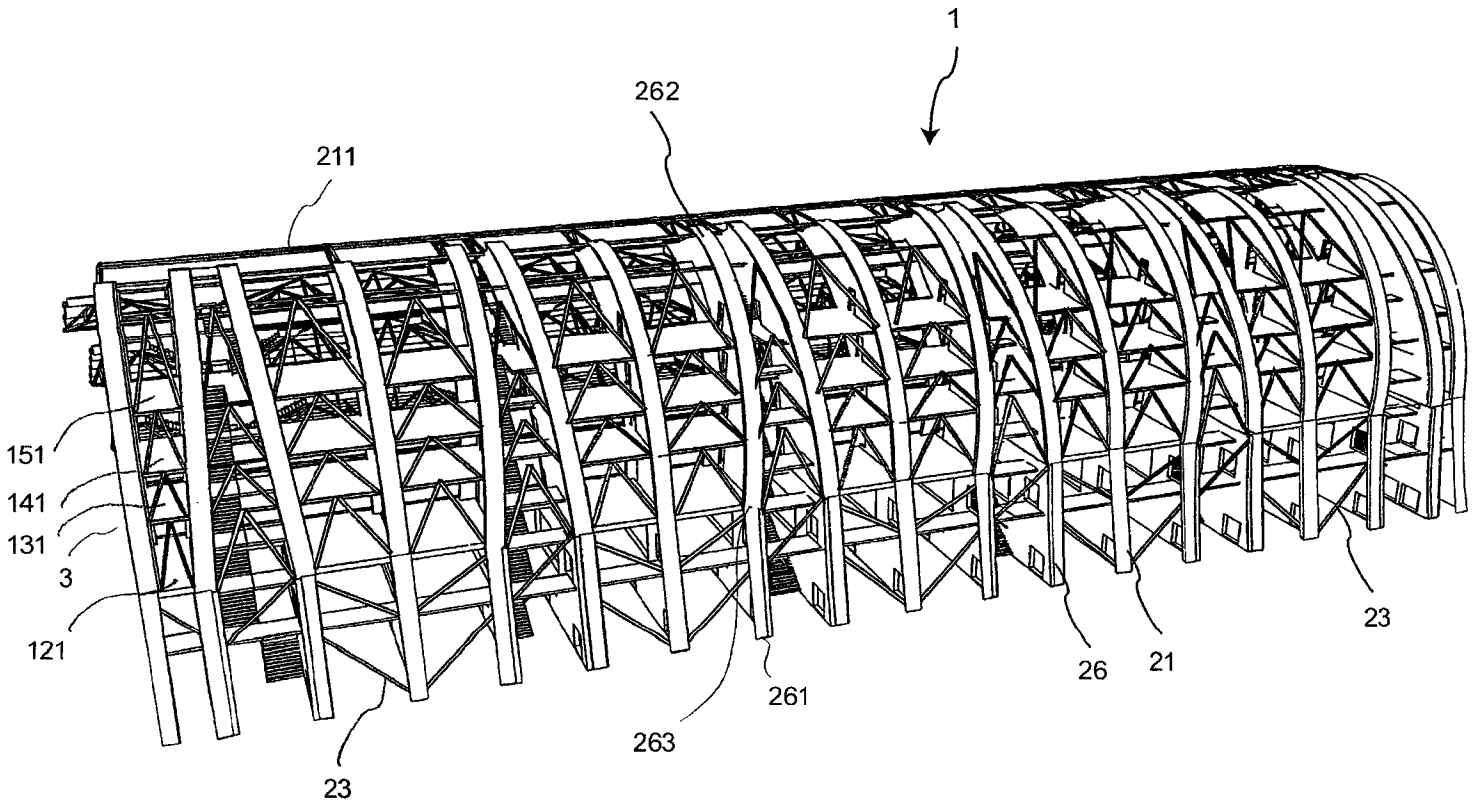
FIG. 6 shows a perspective illustration of the supporting structure of a grandstand according to the invention, from the rear side thereof.
Figure 7:
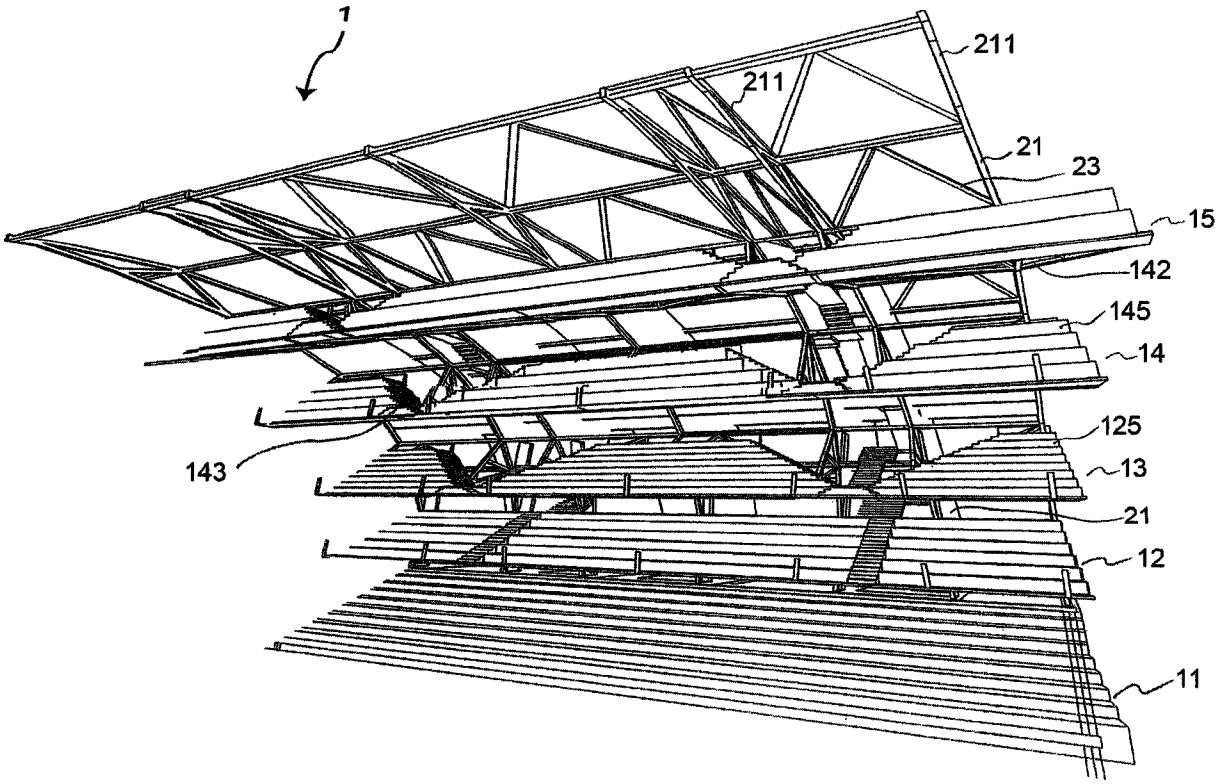
FIG. 7 shows a perspective illustration of the supporting structure from the front side.

The load-bearing structure of an exemplary embodiment of the grandstand 1 will be explained below on the basis of FIGS. 6 and 7. The load-bearing structure 21 or 112, which bears both the roof skin and also the tiers, comprises a multiplicity of disc-shaped elements 26 which are arranged substantially vertically. In the context of the present invention, a vertical arrangement may be understood to include a deviation of ±20° from the vertical. The disc-shaped elements 26 may be of planar form over their entire area or may be divided into longitudinal sections. Illustrated by way of example is a disc-shaped element 26 with a lower longitudinal section 261. The lower longitudinal section 261 is arranged with an inclination of less than 5° with respect to the vertical. Adjoining said lower longitudinal section at a bend line 263 is a second longitudinal section 262 which has a greater inclination with respect to the vertical. The vertical elements of the supporting structure 21 or 112 are however always arranged such that they cannot be walked upon by visitors, such as for example horizontally arranged covering elements.

In the illustrated embodiments of the invention, the disc-shaped elements 26 are formed from reinforced concrete. The disc-shaped elements may optionally be formed as precast concrete parts, as semifinished concrete parts or from cast-in-place concrete in order to permit rapid assembly on the construction site. The embodiment in reinforced concrete has the advantage that a good ratio between mass and rigidity is attained and that the structure exhibits greater damping than a steel or composite structure. The moments introduced by the tiers 13, 14, 15 and 16 thus lead to reduced deformations and the oscillation behaviour is advantageously improved, for example if a multiplicity of users jump up and down or sway in time with one another.

The front edge of the disc-shaped element 26 may be adjoined by an optional additional roof supporting structure 211. Since said additional roof supporting structure is not subjected to the imposed loads of the tiers, it may be formed as a metal structure, for example as a steel structure.

Struts 23 may be provided to diagonally stiffen the areas formed between the disc-shaped elements 26. The struts 23 may be formed either as compressive elements composed of metal or reinforced concrete or else as tensile elements. For tensile elements, aside from steel beams, use may also be made of wire cables. Alternatively or in addition to the struts 23, it is also possible for individual segments such as the stairways to be formed, as a core, from reinforced concrete.

To stagger the tiers in the forward direction in the manner according to the invention, the elements 26 have a forwardly protruding longitudinal portion or surface region.

Since the forward-staggered grandstand 1 according to the invention has the tendency to tilt forward in the direction of the playing field 50, this moment must be supported at the front edge of the grandstand 1 by corresponding counteracting forces. As can be seen from FIG. 2, the disc-shaped elements 26 may be elongated forwards in the direction of the lowermost grandstand 11 and/or connected in a positively locking manner to the grandstand 11. In this way, the lever arm for the moments to be introduced is increased. The tensile and compressive forces under the grandstand 11 onto the foundation are thereby considerably reduced. In this way, structural space on the outer side 70 of the grandstand 1 is saved, and cumbersome deep foundations for corresponding tensile elements are not required. In this way, the grandstand 1 can be erected closer to the boundary of the plot of land, such that for example a public footpath 55 may extend directly up to the grandstand 1.

FIG. 8 shows once again a grandstand according to the invention, and a known grandstand, in section. The illustration shows a lower tier 12 and a multiplicity of upper tiers 13, 14, 15 and 16. For comparison, the illustration also shows a tier 12*a* of a known grandstand which adjoins the lower tier 12 as an elongation thereof.

On the basis of the uppermost space row 145 of the uppermost tier in each case, it will be explained how the grandstand according to the invention improves the viewing conditions.

Assume that the uppermost space row 145*b* of the tier 12*a* of a known grandstand is remote from the playing field by the magnitude X2 and has an elevation of magnitude Y2. The line-of-sight length S2 for the visitor in space row 145*b* is then defined as $$S2 = \sqrt{X2^2 + Y2^2}\,.$$

By contrast, the uppermost space row 145*a* of the tier 16 of a grandstand according to the invention is remote from the playing field by the shorter magnitude X1 and has an increased elevation of magnitude Y1. The line-of-sight length S1 for the visitor in space row 145*a* is then defined as $$S1 = \sqrt{X1^2 + Y1^2}\,.$$

In both cases, the shortest possible line-of-sight length to a sideline 51 adjacent to the grandstand is shown.

Figure 8:
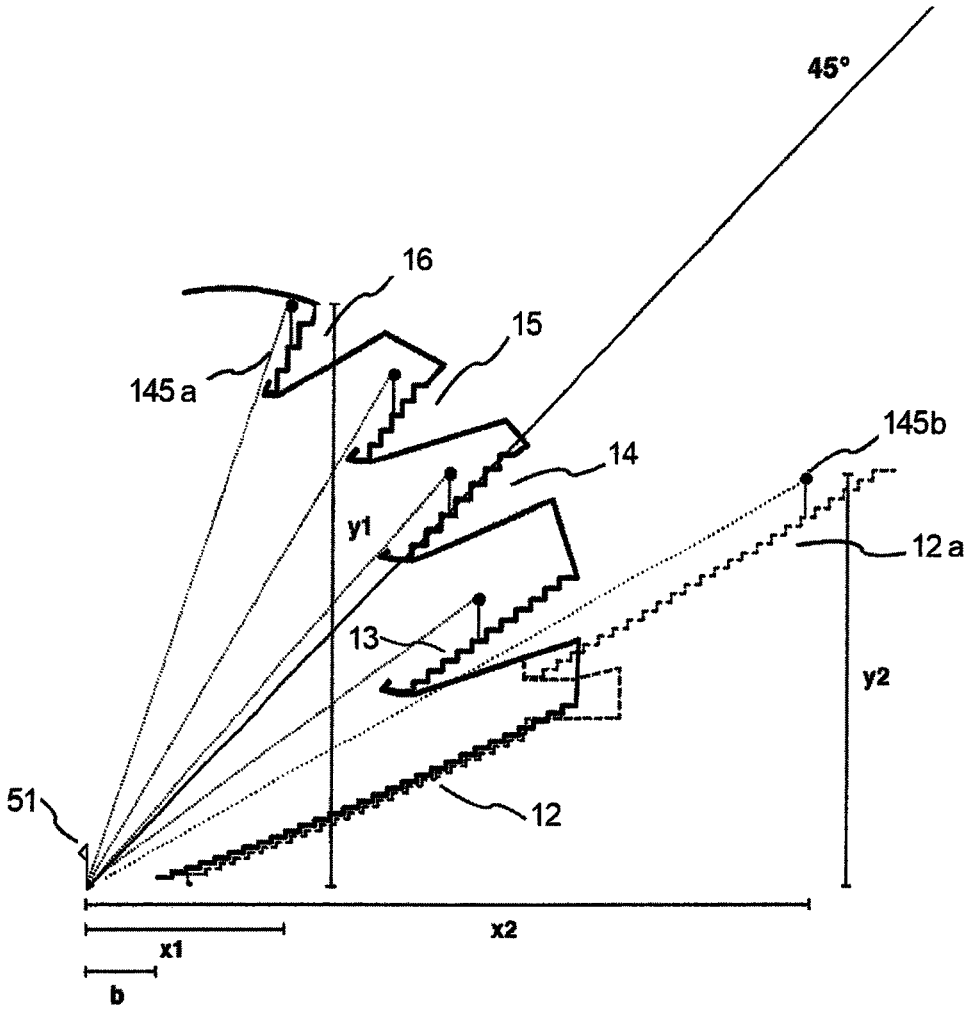
FIG. 8 shows a grandstand according to the invention, and a known grandstand, in section.

As can be seen from FIG. 8, the line of sight S1 is shorter than the line of sight S2. The visitor in space row 145*a* is thus closer to the events than the visitor in space row 145*b*. At the same time, the greater elevation Y1 affords a different, novel visual impression. In this way, the visitor in space row 145*a* is afforded a more impressive experience than the visitor in space row 145*b*. Owing to the changed perspective, the visitor can be afforded a better overview of the events.

Figure 9:
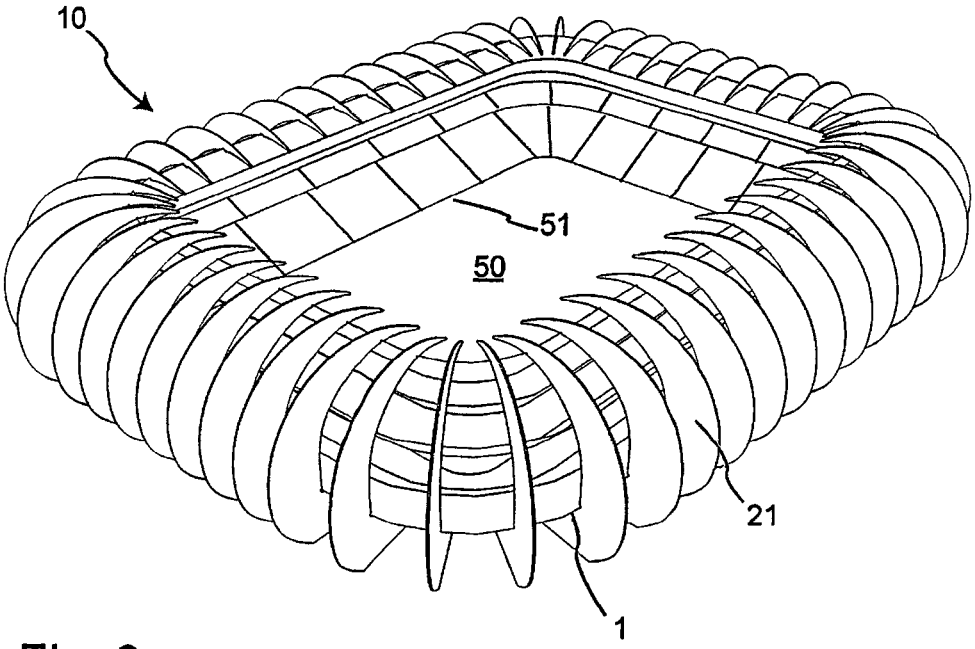
FIG. 9 shows a stadium according to the invention in a view from above.
Figure 10:
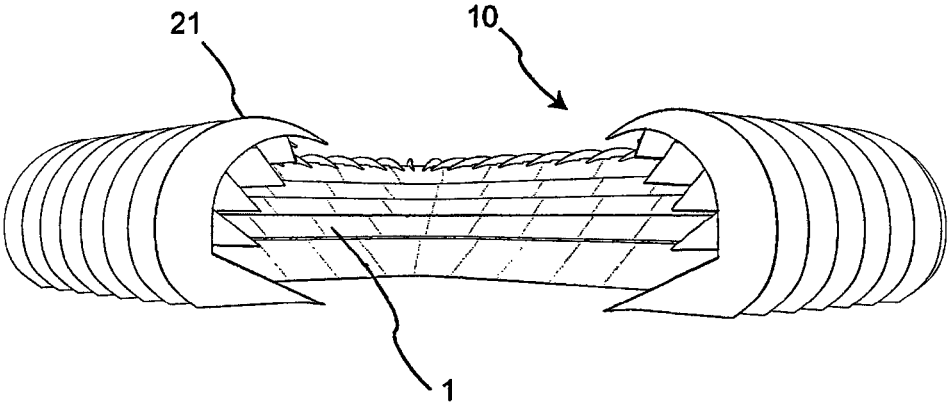
FIG. 10 shows a stadium according to the invention in section.

A stadium according to the invention will be explained on the basis of FIGS. 9 and 10. The stadium has a playing field 50 on which for example a sporting fixture or a concert performance can take place. In some embodiments of the invention, the playing field 50 may be a grass field which can be used for football matches. The playing field is delimited by sidelines 51. At least one grandstand according to the present invention is arranged at a predefinable distance from the sideline 51. The distance from the front edge of the grandstand to the sideline may be for example approximately 0 m to approximately 15 m or approximately 7 m to approximately 10 m or approximately 7 m to approximately 8 m.

In the exemplary embodiment illustrated, the playing field 50 is surrounded on all sides by the grandstands 1 according to the invention. In other embodiments, it is also possible for one or more sides of the playing field to be adjoined by known grandstands or to have no grandstand.

The invention is self-evidently not restricted to the embodiments illustrated in the figures. The above description should therefore be regarded not as restrictive but rather as explanatory. The following claims should be understood in the sense that a stated feature is provided in at least one embodiment of the invention. This does not exclude the presence of other features.

The invention claimed is:

1. A stadium, having at least one playing field and at least one adjoining grandstand having seat rows or standing space rows which rise in a stepped manner, wherein the grandstand has at least one first tier with at least one seat row or standing space row, and at least one second tier with at least one seat row or standing space row located substantially above the first tier, and a centre of the second tier is arranged offset forward in a horizontal direction relative to a centre of the first tier, characterized in that a gradient of at least one tier is greater than 45 degrees, wherein an average horizontal distance from the seat row or standing space row of the second tier to a point in the playing field is smaller than an average horizontal distance from the seat row or standing space row of the first tier to the point in the playing field, wherein a horizontal distance from the seat row or standing space row of the first or second tier to the point in the playing field is smaller than a height of the seat row or standing space row of the first or second tier above the playing field, wherein the point defines a corner or a sideline of the playing field and is placed at a determined distance from an edge of the grandstand, wherein the edge of the grandstand defines a front of the first tier facing the playing field, and is disposed on or above a surface on which the playing field is disposed, wherein a cross-section of the grandstand comprises an inner side with at least one concave longitudinal portion facing the playing field, wherein at least the second tier is structurally attached to, and extends from, the concave longitudinal portion, substantially toward the playing field.

2. The stadium according to claim 1, wherein a plurality of seats or standing spaces in the at least one seat row or standing space row of the first or second tier permits lines of sight proceeding from a head of a visitor in a respective seat or standing space and ending on a line which runs along a longitudinal extent of the grandstand at a viewing distance (b) of approximately 0 to approximately 15 m.

3. The stadium according to claim 2, characterized in that the line runs along the longitudinal extent of the grandstand at a viewing distance (b) of approximately 7 m to approximately 10 m or in that the line runs along the longitudinal extent of the grandstand at a viewing distance (b) of approximately 7 m to approximately 8 m.

4. The stadium according to claim 1, characterized in that more than 90% or more than 95% of seats or standing spaces in the at least one seat row or standing space row of the first or second tier permit lines of sight proceeding from a head of a visitor in a respective seat or standing space and ending on a line which runs along a longitudinal extent of the grandstand at a viewing distance (b) of approximately 0 to approximately 15 m.

5. The stadium according to claim 1, characterized in that, for at least one viewing distance (x), an average line-of-sight length (SO) for a second tier is less than or equal to the average line-of-sight length (SU) for a first tier situated therebelow.

6. The stadium according to claim 1, wherein the grandstand includes a supporting structure that has at least one disc-shaped element which comprises or is composed of reinforced concrete and is arranged substantially vertically.

7. The stadium according to claim 6, characterized in that the supporting structure and a roof have an outer side with the at least one convex longitudinal portion or an inner side with the at least one concave longitudinal portion, and the tiers are arranged on the inner side.

8. The stadium according to claim 6, characterized in that at least one further tier is provided which is arranged at least partially above the second tier and which is fastened to the supporting structure.

9. The stadium according to claim 6, characterized in that the second tier or a further tier generate at least a tensile force in the supporting structure.

10. The stadium according to claim 1, characterized in that an opening is formed between the second tier or the further tier and the roof.

11. The stadium according to claim 1, characterized in that the gradient of the seat rows or standing space rows, which rise in a stepped manner, of a selected tier is smaller than the gradient of the seat rows or standing space rows, which rise in a stepped manner, of the tier situated thereabove.

12. The stadium according to claim 1, characterized in that the gradient of at least one tier is greater than 49 degrees or greater than 55 degrees or greater than 65 degrees.

13. The stadium according to claim 1, characterized in that a number of seat rows or standing space rows in at least one tier decreases with the height of the tier.

14. The stadium according to claim 1, characterized in that sides of the grandstand are at least partially closed off by a weather or sound protection screen.

15. The stadium according to claim 14, characterized in that the weather or sound protection screen is of transparent or translucent form or comprises or is composed of poly (ethylene-co-tetrafluoroethlylene) or a glass.

16. The stadium according to claim 1, characterized in that, on the front edge of at least one tier, on the at least one concave longitudinal portion, there is arranged a catching chamber (60) which is delimited by at least one base panel and a distal delimiting element.

17. The stadium according to claim 1, characterized in that it has at least two upper tiers in which the gradient of each tier is greater than 45 degrees.

18. The stadium of claim 1, wherein the at least one concave longitudinal portion comprises a concave arc.

19. The stadium of claim 18, wherein at least one portion of the arc comprises a straightened shape.

20. The stadium of claim 1, wherein the grandstand comprises a cross-sectional shape of a convergent lens or a focussing mirror, wherein all of lines of sight are oriented towards a line which runs parallel to and in front of the grandstand.

* * * * *